US008746313B2

(12) United States Patent
Kropp

(10) Patent No.: US 8,746,313 B2
(45) Date of Patent: Jun. 10, 2014

(54) CORRECTION TAPE RE-TENSIONING MECHANISM AND CORRECTION TAPE DISPENSER COMPRISING SAME

(75) Inventor: Andrew Kropp, Naperville, IL (US)

(73) Assignee: Sanford, L.P., Oak Brook, IL (US)

( * ) Notice: Subject to any disclaimer, the term of this patent is extended or adjusted under 35 U.S.C. 154(b) by 697 days.

(21) Appl. No.: 12/981,165

(22) Filed: Dec. 29, 2010

(65) Prior Publication Data

US 2012/0168547 A1 Jul. 5, 2012

(51) Int. Cl.
*B65H 37/00* (2006.01)

(52) U.S. Cl.
USPC ..... 156/540; 156/577; 156/579; 156/523; 242/588.2; 242/538.1; 242/394

(58) Field of Classification Search
USPC ..... 242/538–538.3, 396.6, 394, 412.1, 588, 242/588.2; 156/540, 577, 579, 527; 118/76, 118/200, 257; 206/411
See application file for complete search history.

(56) References Cited

U.S. PATENT DOCUMENTS

| | | | |
|---|---|---|---|
| 198,777 | A | 1/1878 | Nicholson |
| 2,907,190 | A | 10/1959 | Pastor |
| 3,443,375 | A | 5/1969 | Cielaszyk |
| 4,671,687 | A | 6/1987 | Tamai |
| 4,704,185 | A | 11/1987 | Fischer |
| 4,718,971 | A | 1/1988 | Summers |
| 4,750,878 | A | 6/1988 | Nix et al. |
| 4,826,562 | A | 5/1989 | Ehlis |
| 4,849,064 | A | 7/1989 | Manusch et al. |
| 4,851,074 | A | 7/1989 | Hiromichi |
| 4,851,076 | A | 7/1989 | Manusch et al. |
| 4,853,074 | A | 8/1989 | Manusch et al. |
| 4,891,090 | A | 1/1990 | Lorincz et al. |
| 4,891,260 | A | 1/1990 | Kunkel et al. |
| 4,997,512 | A | 3/1991 | Manusch |

(Continued)

FOREIGN PATENT DOCUMENTS

| | | |
|---|---|---|
| CA | 2359324 A1 | 7/2000 |
| DE | 37 32 843 A1 | 3/1988 |

(Continued)

OTHER PUBLICATIONS

International Preliminary Report on Patentability for International Application No. PCT/US2011/052272, dated Jul. 2, 2013.

(Continued)

*Primary Examiner* — Sang Kim
*Assistant Examiner* — Nathaniel Adams
(74) *Attorney, Agent, or Firm* — Marshall, Gerstein & Borun LLP

(57) ABSTRACT

A correction tape dispenser includes a body having a plurality of body teeth disposed on an inner surface thereof, an applicator tip mounted in the body, and a supply and take-up assembly mounted in the body, the supply and take-up assembly being biased away from the body teeth with a biasing element. The supply and take-up assembly includes a supply reel and a take-up reel. The supply reel and the take-up reel have a common axis of rotation. One of the supply reel and the take-up reel include a plurality of teeth that engage the plurality of body teeth during correction tape re-tensioning when the biasing force from the biasing element is overcome.

17 Claims, 5 Drawing Sheets

(56) References Cited

U.S. PATENT DOCUMENTS 5,006,184 A 4/1991 Manusch et al.
5,049,229 A 9/1991 Czech
5,125,589 A 6/1992 Manusch
5,135,798 A 8/1992 Muschter et al.
5,150,851 A 9/1992 Manusch et al.
5,221,577 A 6/1993 Inaba et al.
5,242,725 A 9/1993 Weissmann et al.
5,281,298 A 1/1994 Poisson et al.
5,303,759 A 4/1994 Czech
5,310,437 A 5/1994 Tucker
5,310,445 A 5/1994 Tucker
5,316,613 A 5/1994 Samuelson et al.
5,346,580 A 9/1994 Elges et al.
5,379,477 A 1/1995 Tamai et al.
5,380,395 A 1/1995 Uchida
5,393,368 A 2/1995 Stevens
5,430,904 A 7/1995 Ono et al.
5,462,633 A 10/1995 Manusch et al.
5,472,560 A 12/1995 Horng
5,480,510 A 1/1996 Manusch et al.
5,490,898 A 2/1996 Koyama
5,499,877 A 3/1996 Sakanishi et al.
5,507,908 A 4/1996 Fukushima et al.
5,512,128 A 4/1996 Manusch et al.
5,556,469 A 9/1996 Koyama et al.
5,595,626 A 1/1997 Yokouchi et al.
5,679,156 A 10/1997 Matsumaru
5,685,944 A 11/1997 Nose et al.
5,700,552 A 12/1997 Katsuro et al.
5,714,035 A 2/1998 Stevens
5,759,270 A 6/1998 Lee
5,759,341 A 6/1998 Kobayashi
5,770,007 A 6/1998 Czech et al.
5,772,840 A 6/1998 Morinaga
5,785,437 A 7/1998 Koyama et al.
5,792,263 A 8/1998 Koyama et al.
5,795,085 A 8/1998 Yoo
5,820,728 A 10/1998 Stevens et al.
D400,585 S 11/1998 Fritz et al.
5,891,562 A 4/1999 Rutz et al.
5,897,742 A 4/1999 Semmler
5,942,036 A 8/1999 You
5,997,994 A 12/1999 Matsushima
6,000,455 A 12/1999 Semmler
6,059,002 A 5/2000 Katami
6,062,286 A * 5/2000 Koyama et al. ..... 156/540
6,065,887 A 5/2000 You
6,079,660 A 6/2000 Manusch et al.
6,105,650 A 8/2000 Manusch et al.
6,112,796 A 9/2000 Stevens
6,125,903 A 10/2000 Uchida
6,145,770 A 11/2000 Manusch et al.
6,162,492 A 12/2000 Narayanan
6,206,072 B1 3/2001 Orihara et al.
6,227,274 B1 5/2001 Koyama et al.
6,235,364 B1 5/2001 Katsuro et al.
6,260,599 B1 7/2001 You
6,270,578 B1 8/2001 Murakoshi
6,273,162 B1 8/2001 Ohara et al.
6,273,169 B1 8/2001 Ono et al.
6,273,982 B1 8/2001 Semmler
6,321,815 B1 11/2001 You
6,321,816 B1 11/2001 Koreska
6,325,130 B1 12/2001 Kageyama et al.
6,331,352 B1 12/2001 Bradley et al.
6,352,770 B1 3/2002 Nienaber et al.
6,360,805 B1 3/2002 Takahashi
6,363,990 B1 4/2002 Kozaki
6,363,992 B1 4/2002 Semmler
6,379,461 B1 4/2002 Masumoto
6,418,997 B1 7/2002 Tamai et al.
6,422,284 B1 7/2002 Kelders et al.
6,432,515 B1 8/2002 Titze et al.
6,435,248 B1 8/2002 Masumoto
6,450,231 B1 9/2002 Ishikawa
6,453,969 B1 9/2002 Ferrara
6,454,856 B1 9/2002 Jung
6,461,068 B1 10/2002 Holmes
6,481,485 B1 11/2002 Herrmannsen et al.
6,499,524 B1 12/2002 Miller et al.
6,500,259 B1 12/2002 Tamai et al.
6,500,509 B1 12/2002 Katsuro et al.
6,521,045 B1 2/2003 Koyama et al.
6,558,058 B2 5/2003 Masumoto
6,565,657 B2 5/2003 Huthmacher
6,568,450 B1 5/2003 Stevens
6,575,220 B2 6/2003 Tamai et al.
6,582,514 B1 6/2003 Yang
6,595,260 B2 7/2003 Tamai et al.
6,599,363 B2 7/2003 Narita
6,601,632 B2 8/2003 Bouveresse et al.
6,620,238 B2 9/2003 Tsuda et al.
6,622,768 B2 9/2003 You
6,629,552 B1 10/2003 Herrmannsen et al.
6,641,141 B2 11/2003 Schroeder
6,675,856 B2 1/2004 Kozaki
6,681,827 B2 1/2004 Tamai et al.
6,702,491 B2 3/2004 Kobayashi
6,729,377 B2 5/2004 Huthmacher
6,730,186 B2 5/2004 Takahashi
6,732,781 B2 5/2004 Bouveresse
6,732,782 B2 5/2004 Rollion
6,739,369 B2 5/2004 Watanabe
6,745,808 B2 6/2004 Kobayashi
6,761,200 B2 7/2004 Shinya
6,769,470 B2 8/2004 Tamai et al.
6,776,209 B1 8/2004 You
6,783,293 B2 8/2004 Watanabe et al.
6,792,664 B2 9/2004 Herrmannsen et al.
6,796,355 B2 9/2004 Huthmacher et al.
6,802,354 B2 10/2004 Bouveresse
6,805,762 B2 10/2004 Narita et al.
6,808,565 B1 10/2004 Koyama et al.
6,817,398 B2 11/2004 Huthmacher et al.
6,830,089 B1 12/2004 Tamai et al.
6,852,409 B2 2/2005 Bradley et al.
6,896,734 B2 5/2005 Nishioka et al.
6,905,545 B2 6/2005 Tominaga
6,945,492 B2 9/2005 Koreska
6,951,431 B2 10/2005 Rollion
6,966,715 B2 11/2005 Narita et al.
6,997,229 B2 2/2006 Marschand et al.
7,044,187 B2 5/2006 Bebensee et al.
7,059,374 B2 6/2006 Mitsui et al.
7,063,120 B2 6/2006 Huthmacher et al.
7,093,641 B2 8/2006 Sharp
7,093,642 B2 8/2006 Sharp et al.
7,117,915 B2 10/2006 Rolion
7,118,064 B2 10/2006 Schneider
7,121,948 B2 10/2006 Huthmacher et al.
7,163,040 B2 1/2007 Marschand et al.
7,187,573 B2 3/2007 Terada et al.
7,201,961 B2 4/2007 Narimatsu et al.
D541,863 S 5/2007 Gerules
D542,351 S 5/2007 Rolion et al.
D542,845 S 5/2007 Suzuki
D542,846 S 5/2007 Suzuki
D543,238 S 5/2007 Suzuki
D543,239 S 5/2007 Suzuki
D543,240 S 5/2007 Suzuki
D543,241 S 5/2007 Herrmannsen et al.
D543,242 S 5/2007 Rushe et al.
7,228,882 B2 * 6/2007 Marschand et al. ..... 156/523
D549,322 S 8/2007 Stallard et al.
7,275,578 B2 10/2007 Mitsui et al.
7,302,984 B2 12/2007 Mitsui et al.
D562,404 S 2/2008 Jansen et al.
7,325,583 B2 2/2008 Watanabe
7,334,622 B2 2/2008 Stade
7,374,625 B2 5/2008 Panetta et al.
D570,917 S 6/2008 Bailey et al.
D570,918 S 6/2008 Rushe
D571,403 S 6/2008 Rolion et al.
D573,194 S 7/2008 Rushe et al.

(56) References Cited

U.S. PATENT DOCUMENTS

| | | | |
|---|---|---|---|
| D573,195 | S | 7/2008 | Rushe et al. |
| D573,645 | S | 7/2008 | Sommers et al. |
| D574,431 | S | 8/2008 | Kouda |
| D574,432 | S | 8/2008 | Kouda |
| D574,892 | S | 8/2008 | Kouda |
| D577,117 | S | 9/2008 | Biener et al. |
| D579,499 | S | 10/2008 | Rushe et al. |
| 7,438,489 | B2 | 10/2008 | Fujii |
| D579,980 | S | 11/2008 | Rushe et al. |
| D579,981 | S | 11/2008 | Maczuzak et al. |
| D580,497 | S | 11/2008 | Dureiko et al. |
| D580,984 | S | 11/2008 | Kouda |
| D588,644 | S | 3/2009 | Kobayashi |
| D588,646 | S | 3/2009 | Vulpitta |
| D591,354 | S | 4/2009 | Vulpitta |
| RE40,885 | E | 9/2009 | Sharp |
| D600,751 | S | 9/2009 | Gallay |
| D603,903 | S | 11/2009 | Gallay |
| D607,055 | S | 12/2009 | Koreska |
| 7,681,616 | B2 | 3/2010 | Marschand et al. |
| 7,713,606 | B2 | 5/2010 | Kasahara et al. |
| 7,743,810 | B2 | 6/2010 | Rolion et al. |
| D619,655 | S | 7/2010 | Suzuki |
| D620,526 | S | 7/2010 | Suzuki |
| D620,527 | S | 7/2010 | Suzuki |
| D620,528 | S | 7/2010 | Suzuki |
| 7,748,564 | B2 | 7/2010 | Kinugasa et al. |
| D623,231 | S | 9/2010 | Suzuki |
| 2002/0170683 | A1 | 11/2002 | Tamai et al. |
| 2003/0062135 | A1 | 4/2003 | Takahashi |
| 2003/0226733 | A1 | 12/2003 | Huthmacher et al. |
| 2004/0031873 | A1 | 2/2004 | Koreska |
| 2005/0072529 | A1 | 4/2005 | Yonezawa et al. |
| 2005/0155717 | A1 | 7/2005 | Mitsui et al. |
| 2006/0151119 | A1 | 7/2006 | Klauck et al. |
| 2006/0151657 | A1 | 7/2006 | Matsushita |
| 2007/0107851 | A1 | 5/2007 | Marschand et al. |
| 2007/0189829 | A1 | 8/2007 | Matsushita et al. |
| 2008/0078323 | A1 | 4/2008 | Hyodo |
| 2008/0264753 | A1 | 10/2008 | Rolion et al. |
| 2008/0277070 | A1 | 11/2008 | Rolion et al. |
| 2008/0277517 | A1 | 11/2008 | Hyodo |
| 2008/0283194 | A1 | 11/2008 | Mitsui et al. |
| 2008/0308237 | A1 | 12/2008 | Rolion et al. |
| 2009/0025884 | A1 | 1/2009 | Kinugasa et al. |
| 2009/0026302 | A1 | 1/2009 | Kinugasa et al. |
| 2009/0028620 | A1 | 1/2009 | Kinugasa et al. |
| 2009/0050275 | A1 | 2/2009 | Sakanishi |
| 2009/0179061 | A1 | 7/2009 | Dureiko et al. |
| 2009/0202818 | A1 | 8/2009 | Kasahara et al. |
| 2009/0266466 | A1 | 10/2009 | Yamamoto et al. |
| 2010/0018653 | A1 | 1/2010 | Dureiko et al. |
| 2010/0116440 | A1 | 5/2010 | Kai et al. |
| 2010/0206488 | A1 | 8/2010 | Matsushita et al. |

FOREIGN PATENT DOCUMENTS

| | | | |
|---|---|---|---|
| DE | 38 34 097 | C1 | 3/1990 |
| DE | 39 02 553 | C1 | 4/1990 |
| DE | 38 42 350 | A1 | 6/1990 |
| DE | 39 11 402 | A1 | 10/1990 |
| DE | 40 34 145 | A1 | 10/1991 |
| DE | 40 39 683 | A1 | 6/1992 |
| DE | 41 04 331 | A1 | 8/1992 |
| DE | 41 20 031 | C1 | 10/1992 |
| DE | 42 17 294 | A1 | 12/1993 |
| DE | 42 17 295 | A1 | 12/1993 |
| DE | 42 20 712 | A1 | 1/1994 |
| DE | 43 22 117 | C1 | 11/1994 |
| DE | 196 05 811 | C1 | 10/1996 |
| DE | 195 33 567 | A1 | 3/1997 |
| DE | 196 04 617 | A1 | 8/1997 |
| DE | 196 35 587 | A1 | 3/1998 |
| DE | 298 01 395 | U1 | 5/1998 |
| DE | 199 09 217 | A1 | 9/1999 |
| DE | 198 24 551 | A1 | 12/1999 |
| DE | 101 00 932 | A1 | 7/2002 |
| DE | 201 21 351 | U1 | 7/2002 |
| DE | 102 14 604 | A1 | 10/2003 |
| DE | 10 2004 026 720 | A1 | 12/2005 |
| EP | 0 064 358 | A1 | 11/1982 |
| EP | 0 270 736 | A1 | 6/1988 |
| EP | 0 427 870 | A1 | 5/1991 |
| EP | 0 551 522 | A1 | 7/1993 |
| EP | 0 679 597 | A2 | 11/1995 |
| EP | 0 695 645 | A1 | 2/1996 |
| EP | 0 717 000 | A2 | 6/1996 |
| EP | 0 727 378 | A1 | 8/1996 |
| EP | 0 755 889 | A1 | 1/1997 |
| EP | 0 767 128 | A2 | 4/1997 |
| EP | 0 963 934 | A1 | 12/1999 |
| EP | 1306338 | A1 | 5/2003 |
| EP | 1 736 677 | A1 | 12/2006 |
| EP | 1 808 395 | A1 | 7/2007 |
| EP | 2 070 856 | A1 | 6/2009 |
| FR | 2 559 221 | A3 | 8/1985 |
| GB | 2 196 607 | A | 5/1988 |
| IT | 287 492 | | 7/1931 |
| JP | 4-275839 | A | 10/1992 |
| JP | 4-281147 | A | 10/1992 |
| JP | 4-283696 | A | 10/1992 |
| JP | 4-294830 | A | 10/1992 |
| JP | 4-319323 | A | 10/1992 |
| JP | 4-312927 | A | 11/1992 |
| JP | 4-316771 | A | 11/1992 |
| JP | 4-327619 | A | 11/1992 |
| JP | 4-327632 | A | 11/1992 |
| JP | 4-338025 | A | 11/1992 |
| JP | 4-345384 | A | 12/1992 |
| JP | 4-354760 | A | 12/1992 |
| JP | 4-367221 | A | 12/1992 |
| JP | 4-371463 | A | 12/1992 |
| JP | 6 127774 | A | 5/1994 |
| JP | 10 250290 | A | 9/1998 |
| JP | 2000 296696 | A | 10/2000 |
| JP | 2002-036686 | A | 2/2002 |
| JP | 2002-067586 | A | 3/2002 |
| JP | 2004-188804 | A | 7/2004 |
| JP | 2004 299249 | A | 10/2004 |
| JP | 2005-178153 | A | 7/2005 |
| JP | 2005-262448 | A | 9/2005 |
| JP | 2005-271493 | A | 10/2005 |
| JP | 2005-288981 | A | 10/2005 |
| JP | 2006-068962 | A | 3/2006 |
| JP | 2006-069031 | A | 3/2006 |
| JP | 2006-069035 | A | 3/2006 |
| JP | 2006-169415 | A | 6/2006 |
| JP | 2006-181425 | A | 7/2006 |
| JP | 2006-205443 | A | 8/2006 |
| JP | 2006-348234 | A | 12/2006 |
| JP | 2006-348236 | A | 12/2006 |
| JP | 2007-069529 | A | 3/2007 |
| JP | 2007-137956 | A | 6/2007 |
| JP | 2007-161802 | A | 6/2007 |
| JP | 2007-168146 | A | 7/2007 |
| JP | 2007-175886 | A | 7/2007 |
| JP | 2007-182534 | A | 7/2007 |
| JP | 2007-196541 | A | 8/2007 |
| JP | 2007-301835 | A | 11/2007 |
| JP | 2007-326960 | A | 12/2007 |
| JP | 2008-001023 | A | 1/2008 |
| JP | 2008-023871 | A | 2/2008 |
| JP | 2008-080660 | A | 4/2008 |
| JP | 2008-093951 | A | 4/2008 |
| JP | 2008-105194 | A | 5/2008 |
| JP | 2008-156041 | A | 7/2008 |
| JP | 2008-221556 | A | 9/2008 |
| JP | 2008-221775 | A | 9/2008 |
| JP | 2008-238650 | A | 10/2008 |
| JP | 2008-254879 | A | 10/2008 |
| JP | 2008-265042 | A | 11/2008 |
| JP | 2008-279642 | A | 11/2008 |
| JP | 2008-279719 | A | 11/2008 |

(56) References Cited

FOREIGN PATENT DOCUMENTS

| | | | |
|---|---|---|---|
| JP | 2008-307815 | A | 12/2008 |
| JP | 2009-013199 | A | 1/2009 |
| JP | 2009-137752 | A | 6/2009 |
| JP | 2009-143065 | A | 7/2009 |
| JP | 2009-154382 | A | 7/2009 |
| JP | 2009-160761 | A | 7/2009 |
| JP | 2009-255330 | A | 11/2009 |
| JP | 2009-262347 | A | 11/2009 |
| JP | 2009-262348 | A | 11/2009 |
| JP | 2009-285883 | A | 12/2009 |
| JP | 2009-285884 | A | 12/2009 |
| JP | 2009-286046 | A | 12/2009 |
| JP | 2009-297909 | A | 12/2009 |
| JP | 2010-017855 | A | 1/2010 |
| JP | 2010-017992 | A | 1/2010 |
| JP | 2010-069827 | A | 4/2010 |
| JP | 2010-076455 | A | 4/2010 |
| JP | 2010-083086 | A | 4/2010 |
| JP | 2010-105309 | A | 5/2010 |
| WO | WO-97/46475 | A1 | 12/1997 |
| WO | WO-98/41407 | A1 | 9/1998 |
| WO | WO-99/37569 | A1 | 7/1999 |
| WO | WO-2005/108113 | A1 | 11/2005 |
| WO | WO-2005/108260 | A1 | 11/2005 |
| WO | WO-2006/054895 | A1 | 5/2006 |
| WO | WO-2006/128559 | A1 | 12/2006 |
| WO | WO-2008/003714 | A1 | 1/2008 |
| WO | WO-2008/038660 | A1 | 4/2008 |
| WO | WO 2008/038661 | A1 | 4/2008 |
| WO | WO 2008/078534 | A1 | 7/2008 |
| WO | WO-2008/078535 | A1 | 7/2008 |
| WO | WO-2008/078536 | A1 | 7/2008 |
| WO | WO-2008/116702 | A1 | 10/2008 |
| WO | WO-2008/133070 | A1 | 11/2008 |
| WO | WO-2008/133071 | A1 | 11/2008 |
| WO | WO-2008/149936 | A1 | 12/2008 |
| WO | WO-2008/153659 | A2 | 12/2008 |
| WO | WO-2009/026439 | A1 | 2/2009 |
| WO | WO-2009/077494 | A1 | 6/2009 |
| WO | WO-2010/015519 | A1 | 2/2010 |
| WO | WO-2010/023229 | A1 | 3/2010 |
| WO | WO-2010/038604 | A1 | 4/2010 |

OTHER PUBLICATIONS

International Search Report for PCT/US2011/052272, dated Dec. 20, 2011.

Written Opinion of the International Searching Authority for PCT/US2011/052272, dated Dec. 20, 2011.

* cited by examiner

CORRECTION TAPE RE-TENSIONING MECHANISM AND CORRECTION TAPE DISPENSER COMPRISING SAME

BACKGROUND

1. Field of the Disclosure

The disclosure generally relates to correction tape dispensers and specifically to correction tape dispensers that have correction tape re-tensioning mechanisms.

2. Related Technology

Written communication is the primary mode of communication in most of the developed world. Occasionally, errors are made during the drafting or printing of written correspondence. When the written correspondence is ink based, erasure of the error may not be possible, or may introduce unsightly marks into the correspondence. Thus, correction fluids, such as LIQUID PAPER®, were developed in order to correct errors on ink written correspondence. These correction fluids were also formulated to match the color of the underlying substrate and accept ink on top of a film formed by applying the correction fluid to the substrate. In this way, a user is able to conceal an error and to write over the top of the applied correction fluid to correct a written document.

Eventually, tape based correction applicators were developed to correct errors on written correspondence. The correction tapes of these tape based correction applicators are typically formed from a multi-layer tape including at least a first layer providing a correction material, and a second layer providing a carrier/transfer layer. The multi-layer tape is stored on a supply reel in a body/housing. The tape is threaded around an applicator tip and then back into the housing, terminating on and coupled to a take-up reel. When the dispenser is used to apply tape to a substrate (so as to correct an error), the multi-layer tape is pulled from the supply reel over the applicator tip such that the correction material is deposited on the substrate to cover the error and the carrier/transfer layer is correspondingly wound around the take-up reel. However, as the tape becomes depleted, the tape often becomes disengaged from the applicator tip due to the supply and take-up reels rotating at different rates. The supply and take-up reels rotate at different rates throughout a life cycle of these devices because the operational radius of tape on each respective reel changes as tape is drawn off of the supply reel and wound on the take-up reel. These differences in rotation rates eventually result in the tape being taken up more slowly than it is applied to the substrate, which can cause a loop of tape to extend from the device, and thereby render the device virtually unusable. Such tape loops can also form if the consumer inadvertently pulls tape from the device.

In order to correct this tape loop problem, ratcheting mechanisms were developed between the supply reel and the take-up reel. These ratcheting mechanisms essentially include a gear/pawl arrangement which prevents 'backwards' rotation of the take-up spool. As a result, the take-up spool cannot rotate (much if any) in a reverse direction, thereby preventing the carrier/transfer tape from 'unwinding' from the take-up spool and forming a loop of tape extending from the device. In this way, correction tape applicators can be arranged so that the tape is always tensioned between the take up and supply spools within a range that would prevent formation of a tape loop. These ratcheting mechanisms, however, have certain drawbacks. For example, these ratcheting mechanisms often wear out prematurely due to their continuous use, for example, because the gear and pawl structures are constantly engaged throughout the lifetime of the product and the materials (e.g., plastic) with which the supply and take-up reels are made can be easily worn. Further, these ratcheting systems create almost constant noise as the pawl and gear structures of the ratchet (constantly) engage one another. This noise is undesirable from a consumer point of view. Still further, such ratcheting mechanisms can result in discontinuous application of correction material because of the rapid changes in rotation rate as the ratchet teeth slide past the pawl. Consumers tend to dislike the somewhat irregular movement of the reels that result from implementation of the ratcheting mechanism.

SUMMARY OF THE DISCLOSURE

In one embodiment, the correction tape dispenser comprises a body having a plurality of body teeth disposed on an inner surface thereof, an applicator tip mounted in the body, and a supply and take-up assembly mounted in the body, the supply and take-up assembly being biased away from the body teeth with a biasing element. The supply and take-up assembly includes a supply reel and a take-up reel. The supply reel and the take-up reel have a common axis of rotation. One of the supply reel and the take-up reel include a plurality of teeth that engage the plurality of body teeth during correction tape re-tensioning when the biasing force from the biasing element is overcome.

A method of re-tensioning correction tape in a correction tape dispenser includes pressing an adjustment mechanism formed in/on a supply and take-up assembly, thereby moving the supply and take-up assembly towards a first body portion of the correction tape dispenser. As the supply and take-up assembly approaches the first body portion, a plurality of teeth on one of the take-up and supply reels engages a plurality of body teeth on the first body portion, thereby rotationally fixing either the take-up or supply reel with respect to the first body portion. The other of the take-up and supply reels is then rotated relative to the rotationally fixed reel to re-tension correction tape in the correction tape dispenser.

BRIEF DESCRIPTION OF THE DRAWINGS

Exemplary aspects and features of an instrument constructed in accordance with the disclosure are described and explained in greater detail below with the aid of the drawing figures in which.

DETAILED DESCRIPTION

The correction tape dispenser according to the disclosure comprises a body having a plurality of body teeth disposed on an inner surface thereof, an applicator tip mounted in the body, and a supply and take-up assembly mounted in the body, the supply and take-up assembly being biased away from the body teeth with a biasing element. The supply and take-up assembly includes a supply reel and a take-up reel. The supply reel and the take-up reel have a common axis of rotation. One of the supply reel and the take-up reel include a plurality of teeth that engage the plurality of body teeth during correction tape re-tensioning when the biasing force from the biasing element is overcome.

One or more elements of the correction tape dispenser according to the present disclosure form a correction tape re-tensioning mechanism. The re-tensioning mechanism is used to adjust tension in the correction tape during use, for example, to correct the looping that can occur because of the changing diameters of the supply and take-up reels over the lifetime of the correction tape dispenser. The correction tape dispenser is advantageously able to avoid the discontinuous application rate and irregular rotation/movement of the reels associated with known correction tape dispensers incorporating ratcheting mechanisms. Moreover, by avoiding contact between the reel teeth and the body teeth during normal use, the correction tape dispenser according to the present disclosure is able to advantageously avoid the noise associated with ratcheting, provide more continuous tape application, and achieve a longer lifespan at least relative to known correction tape dispensers incorporating the ratcheting mechanism.

Figure 1:
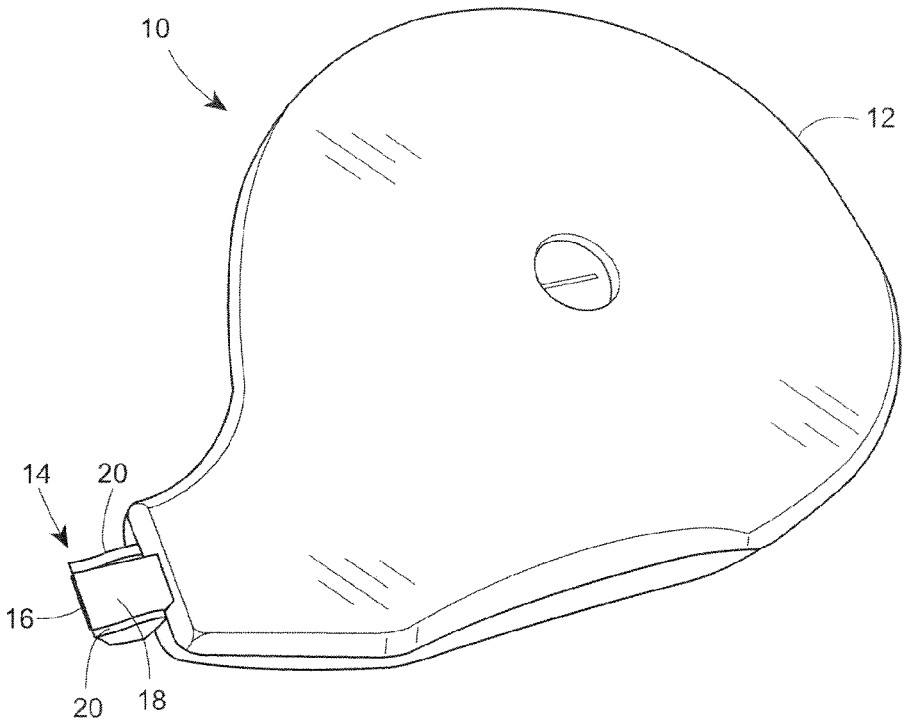
FIG. 1 is a perspective view of a correction tape dispenser constructed in accordance with the teachings of the disclosure.

FIG. 1 illustrates one embodiment of a correction tape dispenser 10 including a correction tape re-tensioning mechanism constructed in accordance with the teachings of the disclosure. The correction tape dispenser 10 includes a body 12 and an applicator tip 14. The applicator tip 14 directs correction tape from within the body 12 onto a substrate (not shown) and back into the body 12. The applicator tip 14 may have a supply side 16 and a take-up side 18. Correction tape extends around the applicator tip 14 from the supply side 16 to the take-up side 18. As the correction tape transitions from the supply side 16 to the take-up side 18, a first ply of the correction tape, e.g., a correction ply, separates from a second ply of the correction tape, e.g., a carrier ply, and the first ply remains on the substrate covering any markings on the substrate that are disposed under the first ply. The second ply continues around the applicator tip 14 on the take-up side 18 and into the body 12 where the second ply is stored. The applicator tip 14 may include one or more directional features, such as guide surfaces or ribs 20, that keep the correction tape properly aligned as the correction tape travels across the applicator tip 14.

Figure 2:
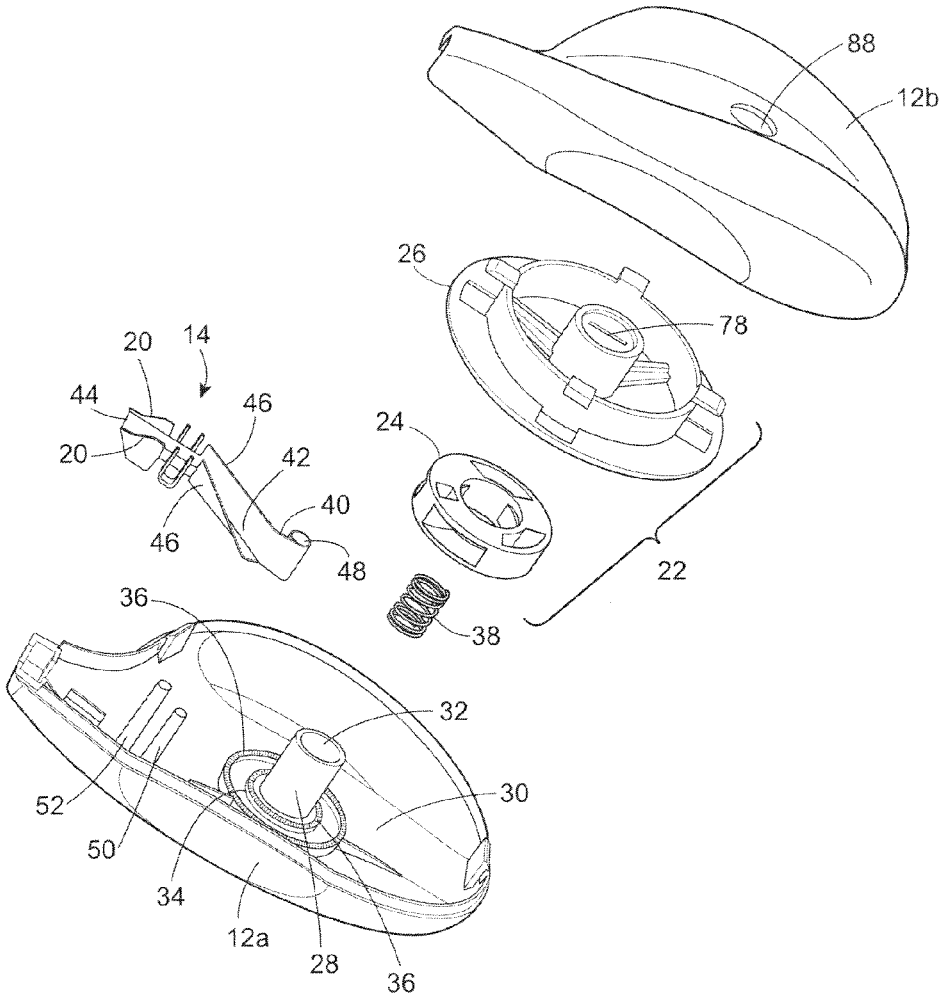
FIG. 2 is an exploded perspective view of the correction tape dispenser of FIG. 1.

As illustrated in FIG. 2, the body 12 may include first and second body parts 12*a*, 12*b* that are connected with one another by any conventional means, such as adhesive, snap-fit, bonding, etc. The first and second body parts 12*a*, 12*b* contain the applicator tip 14 and a correction tape re-tensioning mechanism that includes a supply and take-up assembly 22. The supply and take-up assembly 22 includes a supply reel 24 and a take-up reel 26. The supply reel 24 and the take-up reel 26 share a common axis of rotation (i.e., the supply reel and the take-up reel 26 are co-axially mounted within the body 12). The supply and take-up assembly 22 is rotatably mounted in the body 12 so that friction created by moving the tip 14 in contact with and then across a substrate produces a force that pulls the correction tape off of the supply reel 24, causing the supply and take-up reels 24, 26 of assembly 22 to rotate, thereby providing correction tape from the supply reel 24 to the applicator tip 14 and rewinding the return carrier ply of the correction tape on the take-up reel 26.

The first body part 12*a* may include a pillar 28 located on an inner surface 30 of the first body part 12*a*. The pillar 28 may be cylindrical in shape including a blind bore 32. The supply and take-up assembly 22 is rotatably mounted on the pillar 28 in this embodiment. The pillar 28 may be surrounded, at least partially, by a platform 34 that is elevated above the inner surface 30. The platform 34 may include one or more pluralities of body teeth 36*a*, 36*b*, the function of which will be described further hereinafter. A biasing device, such as a spring 38, biases the supply and take-up assembly 22 away from the first housing part 12*a* and toward the second housing part 12*b*. The spring 38 is sized to be at least partially disposed within the blind bore 32. In other embodiments, the spring 38 may be molded into the supply and take-up assembly 22. For example, in other embodiments the spring 38 may be molded in the hollow central bore 62 of the supply reel 24. While a coil spring 38 is illustrated in the drawings, other types of springs may be used, for example, coil springs such as helical, volute, or torsion springs, or flat springs, such as Belleville washers or leaf springs.

The applicator tip 14 includes a supply surface 40 and a return surface 42. Correction tape leaves the supply reel 24, travels over the supply surface 40, and across a contact tip 44, where the first ply adheres to the substrate. The second ply travels over the return surface 42 and to the take-up reel 26, where the second ply is rewound about the take-up reel 26 and stored. The supply and return surfaces 40, 42 may include one or more guide surfaces 46, similar to the ribs 20, that keep the correction tape centered on the supply surface 40 and/or the return surface 42. The supply surface 40 and the return surface 42 may be curved or twisted, changing an orientation of the correction tape by approximately 90 degrees between the supply reel 24 and the contact tip 44. Changing the orientation of the correction tape by approximately 90 degrees results in a more compact supply and take-up assembly 22, and thus a more compact body 12. The applicator tip 14 may also include a hinge 48 for mounting on a hinge post 50 formed on the inner surface 30 of the first body part 12*a*. A guide post 52 may be located near the hinge post 50 and proximate the supply surface 40 when the applicator tip 14 is mounted in the body 12. The correction tape may be threaded between the guide post 52 and the supply surface 40. The guide post 52 directs the correction tape to maintain positive contact with the supply surface 40.

Figure 3:
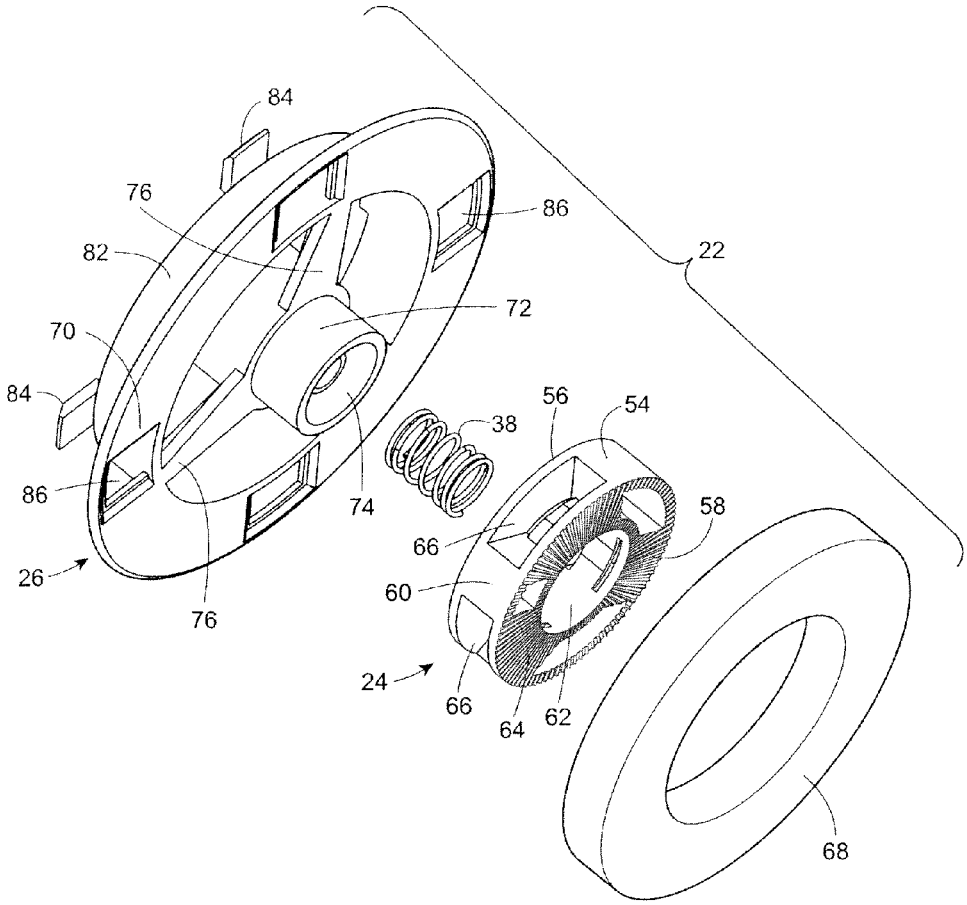
FIG. 3 is an exploded perspective view of a tape spool assembly of the correction tape dispenser of FIG. 1.

FIG. 3 illustrates the supply and take-up assembly 22 in more detail. The supply reel 24 includes a disk or puck-shaped body 54 having a first or top surface 56, a second or bottom surface 58, and a side surface 60. A hollow central bore 62 extends from the first surface 56 to the second surface 58. The second surface 58 includes a plurality of reel teeth 64. The plurality of reel teeth 64 interact with at least one of the pluralities of body teeth 36 on the platform 34, as will be discussed further hereinafter. In alternative embodiments, the relative positioning of the supply reel 24 and the take-up reel 26 may be reversed and the take-up reel 26 may include a plurality of reel teeth 64 that interact with at least one of the pluralities of body teeth 36. The reel teeth 64 in the alternative embodiments may be located virtually anywhere on the take-up reel 26 as long as the reel teeth 64 are engageable with the body teeth 36. The side surface 60 of the supply reel 24 may include one or more windows 66 that extend from the side surface completely through the body 54 to the hollow central bore 62. In other embodiments, the one or more windows 66 may extend only partially into the body 54, in yet other embodiments, the windows 66 may be eliminated. The windows 66 may reduce overall weight of the supply reel 24 and/or to improve manufacturability of the supply reel 24 during a molding process. The two-ply correction tape 68 is wound on the side surface 66 of the supply reel 24 during assembly.

Figure 4A:
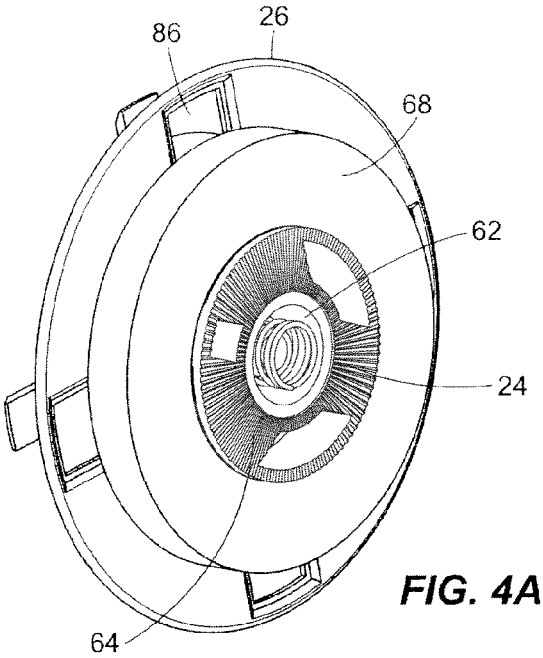
FIGS. 4A and 4B are perspective views of a supply spool and a take-up spool of the tape spool assembly of FIG. 3.
Figure 4B:
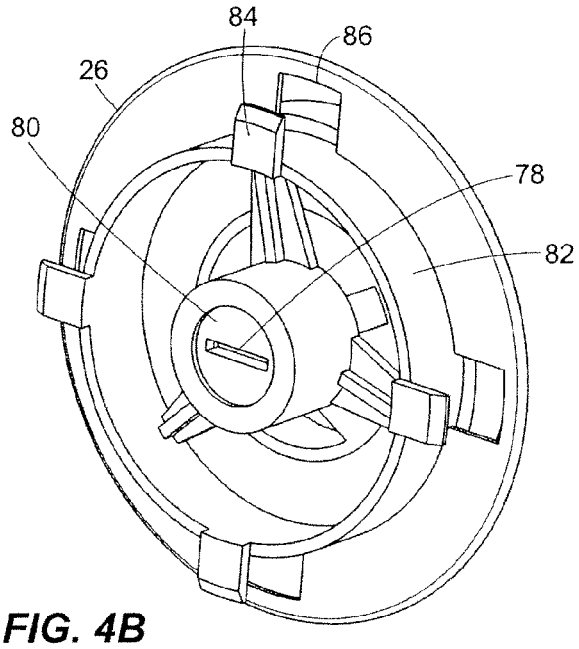

The take-up reel 26 includes a center disk 70 connected to a hub 72 having a blind bore 74. The center disk 70 is connected to the hub 72 by a plurality of spokes 76. In other embodiments, the center disk 70 may extend completely to the hub 72, thereby eliminating the need for spokes 76. Opposite the blind bore 74 is an adjustment mechanism 78 (FIG. 4B). The adjustment mechanism 78 is formed in a first or top surface 80 of the hub 72. The adjustment mechanism 78, may include an adjustment head having a tool accepting feature, such as a slot in one embodiment, that is sized and shaped to receive a tool (not shown) during a correction tape re-tensioning procedure or process. The tool accepting feature may take on virtually any shape, such as a slot, two perpendicular slots, a star, a square, or virtually any other shape that is complimentary to a tool. Moreover, instead of a slot or recess, the tool accepting feature may include a raised portion in the shape of, for example, a square, for inserting into a recessed portion of a tool. Regardless of the shape of the tool accepting feature on the adjustment mechanism 78, a tool (not shown) may interact with the adjustment mechanism 78 to move the take-up reel 26 relative to the supply reel 24, as will be discussed further hereinafter.

The take-up reel 26 also includes a rewind ring 82 for rewinding the second ply of the correction tape after the first ply is deposited on the substrate. The rewind ring 82 may include a plurality of rewind guides 84 to guide the second ply onto the rewind ring 82. The center disk 70 may include a plurality of openings 86 generally aligned with the rewind guides 84. The openings 86 may reduce the amount of material needed for manufacture, and thus the overall weight of the take-up reel 26. The openings 86 may also improve manufacturability during the molding process. In other embodiments, the openings 86 need not be aligned with the rewind guides 84, and in still other embodiments, the openings 86 may be eliminated.

The supply reel 24 may be frictionally and co-axially (i.e., share a common axis of rotation) mounted on the hub 72 of the take-up reel 26 so that the supply reel 24 and the take-up reel 26 are rotatable relative to one another. However, friction between the supply reel 24 and the take-up reel 26 is generally greater than the amount of torque provided by the unwinding correction tape when applying correction tape to a substrate during use of the device. Thus, the supply reel 24 and the take-up reel 26 remain rotationally fixed with respect to one another, due to friction, unless acted upon by a force that overcomes the friction. Other embodiments may include structural features, such as snap-fit assemblies, that attach the supply reel 24 to the take-up reel 26 in a manner that allows rotational movement between the two reels when friction between the two wheels is overcome.

Figure 5A:
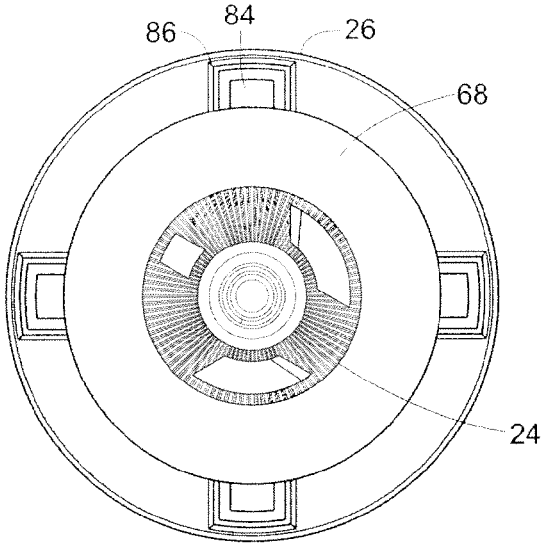
FIGS. 5A and 5B are top and bottom plan views, respectively, of the supply spool and take-up spool of FIGS. 4A and 4B.
Figure 5B:
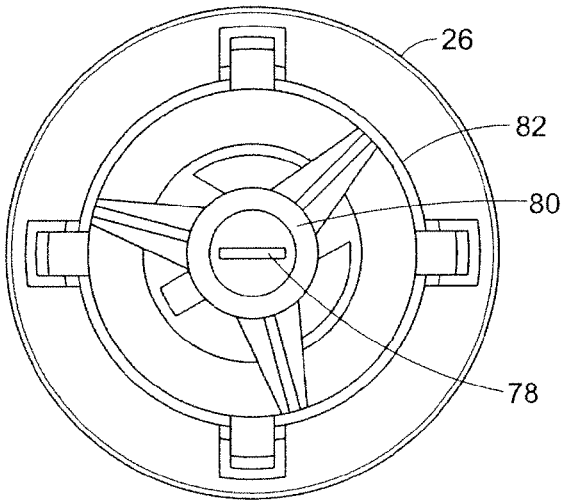
Figure 6:
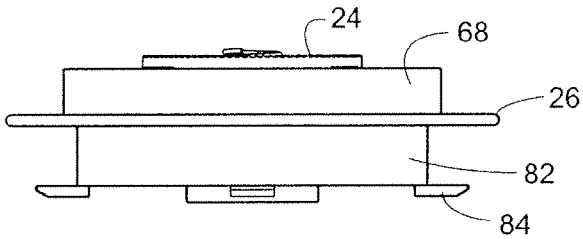
FIG. 6 is a side elevational view of the supply spool and take-up spool of FIGS. 4A and 4B.

During use, tape unwinds from the supply reel 24 at urate that is different from the rate at which tape is rewound on the take-up reel 26 due to the different outer diameters of the first ply 68 on the supply reel 24 and the second ply on the rewind ring 82 (FIGS. 5A, 5B, and 6). The relative diameters between the tape on the supply reel 24 and the tape on the take-up reel 26 change throughout the life cycle of the device. This difference in wind/rewind rates can lead to tape looping outside of the body 12, as discussed earlier. To correct a tape loop, a consumer may insert a tool, such as a screwdriver or a coin, into the adjustment mechanism 78 and push the supply and take-up assembly 22, towards the first body portion 12*a*, against spring force from the spring 38. The supply and take-up assembly translates generally along the axis of rotation of the supply and take-up assembly 22. As the supply and take-up assembly 22 moves towards the first body portion 12*a*, the reel teeth 64 on the supply reel 24 engage the body teeth 36 on the platform 34. Once the reel teeth 64 and the body teeth 36 are engaged with one another, the supply reel 24 is rotationally fixed with respect to the first body portion 12*a*. As the consumer turns the tool, the take-up reel 26 rotates once friction between the take-up reel 26 and the supply reel 24 is overcome. Once the take-up reel 26 begins to rotate relative to the supply reel 24, the correction tape begins to rewind on the take-up reel 26 without more correction tape being pulled from the supply reel 24. The correction tape is rewound on the take-up reel 26 until the tape loop is eliminated and a proper tension is restored to the correction tape. The adjustment feature is accessible through an opening 88 in the second body part 12*b* (See FIG. 2). Although two pluralities of body teeth 36 are illustrated in the embodiment of FIGS. 1-6, other embodiments may include a single plurality of body teeth 36. The two pluralities of body teeth 36 disclosed in the embodiment of FIGS. 1-6 enhance manufacturability of the disclosed correction tape dispenser, by reducing the number of thicker areas on the housing, while improving bite between the body teeth 36 and the reel teeth 64.

Once the correction tape re-tensioning procedure is complete and the tape loop is eliminated, a consumer may remove pressure from the adjustment mechanism 78 by removing the tool. As the tool is removed, spring force from the spring 38 moves the supply and take-up assembly away from the first body part 12*a*, thereby disengaging the body teeth 36 and the reel teeth 64. Once the body teeth 36 and the reel teeth 64 are disengaged, friction between the supply reel 24 and the take-up reel 26 again maintains relative rotational positioning between the supply reel 24 and the take-up reel 26.

The re-tensioning mechanism in the disclosed correction tape dispenser includes certain advantages over prior art tape tensioning mechanisms. In particular, the disclosed re-tensioning mechanism is quiet. In other words, the re-tensioning mechanism emits very little or no sound during the re-tensioning procedure. This quiet operation is due to the smooth surfaces on the supply reel and the take-up reel that slide relative to one another during the re-tensioning procedure. Moreover, the disclosed re-tensioning mechanism is more reliable and has a longer useful life than known ratchet-type mechanisms. In the disclosed re-tensioning mechanism, the teeth on the body and a corresponding supply or take-up reel are only engaged during the re-tensioning procedure when a user activates the mechanism by pushing on the adjustment feature. The teeth do not slide over one another, and thus do not experience the wear and tear of ratchet teeth that are constantly sliding over one another. Moreover, the disclosed re-tensioning system requires fewer elements than known ratcheting systems, thereby reducing manufacturing costs.

Although certain correction tape dispensers and re-tensioning mechanisms have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. Accordingly, it is the intention to protect all variations and modifications that may occur to one of ordinary skill in the art.

What is claimed is:

1. A correction tape dispenser, comprising:

a body including a first body portion and a second body portion, the first body portion having a first plurality of teeth disposed on an inner surface of the first body portion;

an applicator tip mounted within and protruding from an opening in the body;

a supply and take-up assembly mounted within the body, the supply and take-up assembly including a supply reel and a take-up reel, the supply reel and the take-up reel having the same axis of rotation, at least one of the supply reel and the take-up reel having a plurality of reel teeth; and a biasing element that biases the supply and take-up assembly away from the plurality of teeth disposed on the inner surface of the first body portion to thereby seprate the first plurality of teeth from the plurality of reel teeth.

2. The correction tape dispenser of claim 1, wherein the biasing element is a spring.

3. The correction tape dispenser of claim 1, wherein the second body portion includes an opening and an adjustment mechanism on the take-up reel is accessible through the opening.

4. The correction tape dispenser of claim 1, wherein the biasing element is at least partially disposed in a blind bore formed on the inner surface of the first body part.

5. The correction tape dispenser of claim 1, wherein the plurality of reel teeth is disposed on the supply reel.

6. The correction tape dispenser of claim 1, further comprising a second plurality of teeth on an inner surface of the first body portion.

7. The correction tape dispenser of claim 6, wherein the first and second pluralities of body teeth are disposed on a platform.

8. The correction tape dispenser of claim 1, wherein the take-up reel includes a rewind ring for rewinding a ply of correction tape.

9. The correction tape dispenser of claim 8, wherein the rewind ring includes at least one rewind guide.

10. The correction tape dispenser of claim 1, wherein the take up reel includes a hub and the supply reel includes a central through bore, the central through bore being mounted on the hub.

11. The correction tape dispenser of claim 10, wherein the hub includes a blind bore.

12. The correction tape dispenser of claim 11, wherein the take-up reel includes an adjustment mechanism.

13. The correction tape dispenser of claim 12, wherein the adjustment mechanism comprises an adjustment head including a slot.

14. The correction tape dispenser of claim 13, wherein the adjustment slot is located opposite of the blind bore.

15. A method of re-tensioning correction tape in a correction tape dispenser including a body and a supply and take-up assembly having a supply reel frictionally mounted to a take-up reel, the method comprising:

pressing an adjustment mechanism formed in the supply and take-up assembly;

moving the supply and take-up assembly toward the body;

engaging teeth on the supply and take-up assembly with teeth on the body, by overcoming a force biasing the engaging teeth of the supply and take-up assembly away from the teeth on the body, to rotationally fix one of the supply reel and the take-up reel relative to the body; and rotating the one of the supply reel and the take-up reel relative to the fixed one of the supply reel and the take-up reel.

16. The method of claim 15, further comprising:

biasing the supply and take-up assembly away from a portion of the body.

17. The method of claim 15, wherein the adjustment mechanism is accessed through an opening in the body.

* * * * *